US006125747A

United States Patent [19]

Elliott

[11] Patent Number: 6,125,747

[45] Date of Patent: Oct. 3, 2000

[54] GOLF BALL MARKER

[76] Inventor: Martin P. Elliott, 1111 Ironwood Dr., Coeur d'Alene, Id. 83814

[21] Appl. No.: 08/900,680

[22] Filed: Jul. 25, 1997

[51] Int. Cl.[7] ..... B41F 17/28

[52] U.S. Cl. ..... 101/41; 101/35

[58] Field of Search ..... 101/DIG. 40, 41, 101/35, 333, 405, 406

[56] References Cited

U.S. PATENT DOCUMENTS

| | | | |
|---|---|---|---|
| 1,814,170 | 7/1931 | Long | 101/DIG. 40 |
| 1,999,647 | 4/1935 | Atti | 101/DIG. 40 |
| 4,803,922 | 2/1989 | Dennesen | 101/DIG. 40 |
| 5,743,180 | 4/1998 | Arnke | 101/DIG. 40 |

*Primary Examiner*—John Hilten
*Attorney, Agent, or Firm*—Michael G. Petit

[57] ABSTRACT

A golf ball accessory is provided which affixes a personalized visual indicia to the outer surface of a golf ball for the purposes of identification. The accessory can be conveniently stored in a golf bag compartment normally used for storing golf balls. The accessory includes a generally golf-ball shaped casing having an ink stamp and a printing surface housed therewithin. The generally spherical accessory is comprised of two separable hemispherical halves. The halves snap together in mating engagement. When the halves are separated, a stamp portion presents a concave outer surface with a radial curvature substantially equal to that of a golf ball. A complementary convex ink pad housed within the opposing half of the accessory provides ink for the stamp. A golf ball is placed against the stamp portion and an ink image of indicia embossed thereon is transferred to the surface of the golf ball. After use, the halves are snapped together in such a way that the stamp and the ink pad are in fluid communication for transferring ink to the stamp for re-use.

2 Claims, 3 Drawing Sheets

GOLF BALL MARKER

BACKGROUND OF THE INVENTION

1. Field of the Invention

A golf accessory for embossing or monogramming the outer surface of a golf ball for the purpose of identification.

2. Prior Art

It is customary in the manufacturing process used for making golf balls to include a visual indicia on the outer covering of the ball to identify the manufacturer and to provide trademark information. In this process the outer surface of the ball is marked with an ink and covered with a transparent polyurethane coating and/or a "golf ball paint". The outer transparent covering provides protection for the ink marked on the ball during use. While such a marking system used in manufacture may be useful for identifying the manufacturer and style of ball being used by a player, it does not identify the particular player who is using the ball.

Golf ball marking accessories are known in the art. The stamping mechanism is generally in the form of a stamp pad and a stamp. Such accessories have an odd shape, that is, a shape unlike any other accessory used in golf Thus, the storage of the marking device poses a problem. If the device is placed in a pocket with the golf balls, the device, being only occasionally used, may naturally migrate to the bottom of the bag and present a problem for retrieval. On the other hand, if the device is placed in other pockets or in general anywhere within a bag, the stamp can be lost or separated from the ink pad providing a different sort of retrieval problem.

A personalized accessory is needed for which is conveniently stored within a compartment of a golf bag and which enables golfers to recognize their own golf ball and distinguish it from other player's golf balls during play.

SUMMARY OF THE INVENTION

It is a first object of this invention to provide a golf-ball marker accessory for use by a golfer to provide a personal identifier on the surface of a golf ball.

It is another object of this invention to provide a golf ball marking accessory which resists rolling off of a flat surface.

It is still another object of this invention to provide a golf ball marker accessory which can be placed in a pocket with other golf balls, yet is readily distinguished from the regular golf balls by touch alone.

The features of the invention believed to be novel are set forth with particularity in the appended claims. However, the invention itself both as to organization and method of operation, together with further objects and advantages thereof may best be understood by reference to the following description taken in conjunction with the accompanying drawings in which:

DESCRIPTION OF THE PREFERRED EMBODIMENT

Figure 1:
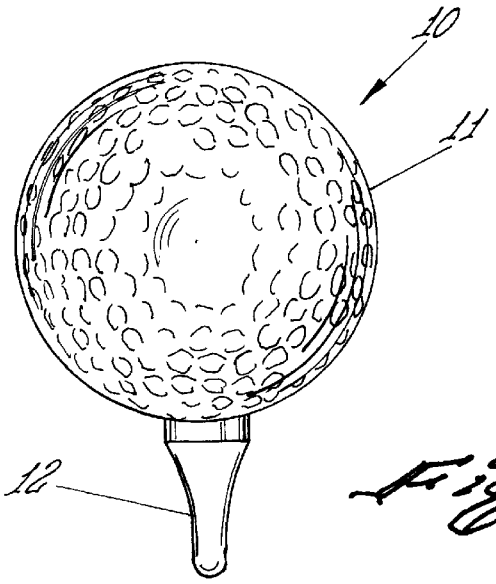
FIG. 1 is a front elevational view of a golf ball marking accessory in accordance with the present invention.
Figure 2:
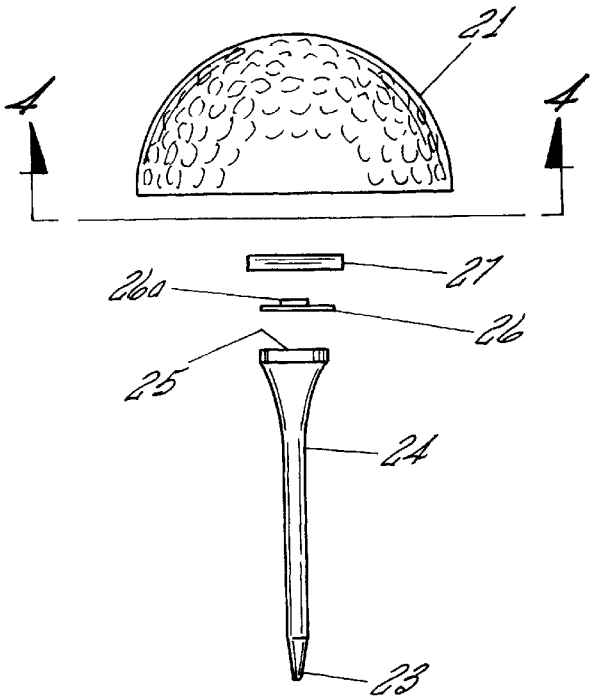
FIG. 2 shows a front elevational exploded view of the golf ball marking accessory in accordance with the present invention.
Figure 2:
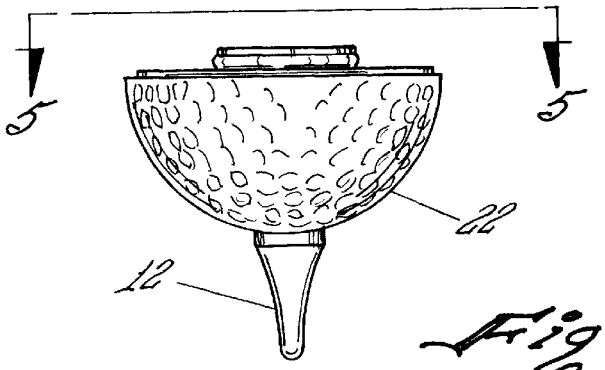

An embodiment of a marking device in accordance with the present invention is shown in FIG. 1. The device 10 comprises a generally spherical golf ball-shaped casing 11 having a projection 12 protruding therefrom adapted to house a portion of a golf tee therewithin. An exploded front elevational view of the device 10 is shown in FIG. 2. The case 11 comprises an upper, ink pad portion 21 and a lower stamp portion 22. The inking portion 21 and the stamp portion 22 of the case 11 are molded separately to have unitary construction and snap together. The stamp portion 22 has protuberance 12 projecting radially from the surface thereof A stamp pad holder 24, similar in construction to a golf tee, having a proximal end 23 and a distal end 25 fits within the projection 12 in the stamp portion 22.

The upper surface 25 of the stamp holder 24 is coated with an adhesive (not shown) to which the lower surface of a stamp 26 adheres. The stamp 26 has an indicia 26*a* on the upper surface thereof which, when the case halves are attached to one another, is in fluid communication with an ink pad 27. Ink pad 27 is adhered to a recess within the ink pad portion 21 of the casing.

Figure 3:
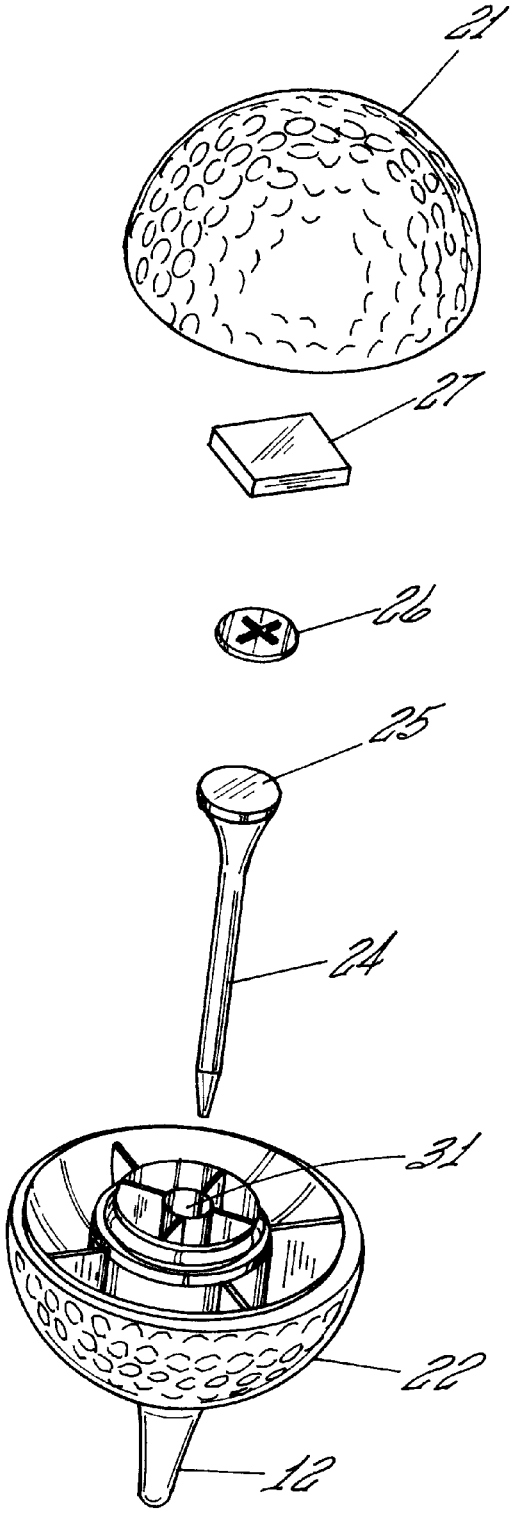
FIG. 3 shows a perspective elevational exploded view of the golf ball marking accessory of the present invention.

FIG. 3 shows the device in perspective with the various portions being more clearly apparent. An opening 31 in the top of the projection 12 is dimensioned to accommodate the proximal end 28 of the stamp holder 24 The stamp holder 24 may be removed from the stamp portion 22 of the casing as needed.

Figure 4:
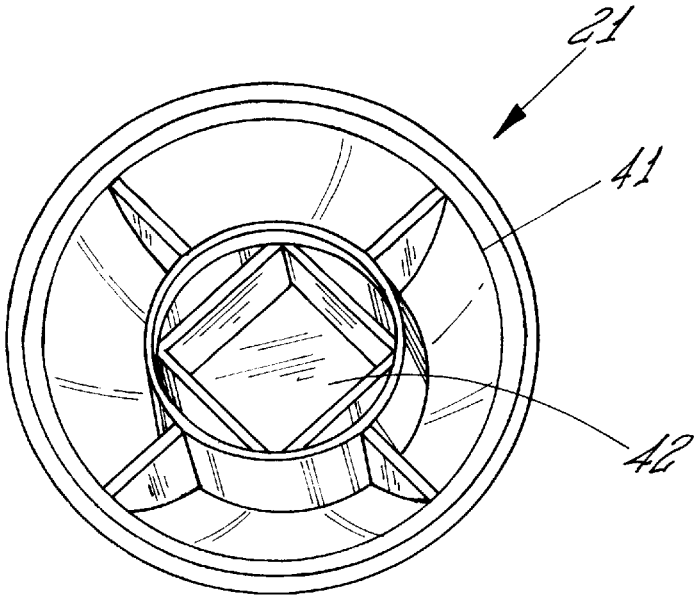
FIG. 4 is view of one hemispherical portion of the casing of the golf ball marking accessory in accordance with the present invention housing the inking pad.

Turning now to FIG. 4, the ink pad portion 21 of the casing is shown as viewed along section line 4—4 of FIG. 2. The casing 21 has a recess 42 centered therewithin dimensioned to receive ink pad 27 (not shown in FIG. 4). The outer periphery of the casing 21 has an elastically deformable groove 41 extending around the periphery thereof The groove 41 is dimensioned to matingly engage a ring on the stamp portion to be discussed later.

Figure 5:
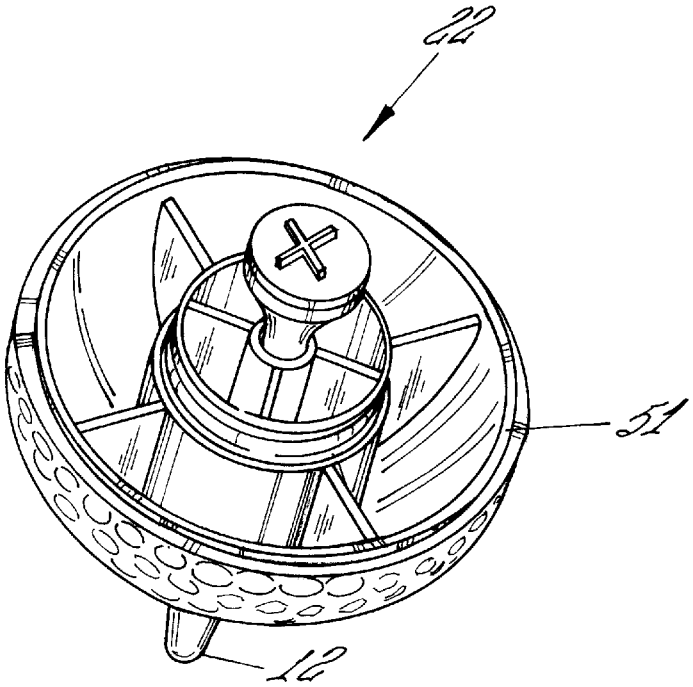
FIG. 5 is a perspective top view taken along FIG. 5—5 of FIG. 2 showing the structural relationship of the marking device and the hemispherical casing.

FIG. 5 is a view of the stamp portion of the casing viewed along view line 5—5 of FIG. 2. The periphery of the stamp portion 22 of the casing has a ridge 51 extending around the periphery thereof which is overcut to snap into the groove 41 on the opposing half of the casing. When the ink pad portion 21 and the stamp portion 22 are matingly engaged, that is, forced together, the elastically deformable ridge 51 deflects inwardly due to its elastic nature and snaps into the corresponding recessed groove 41 within the ink pad portion 21 thereby holding the stamp pad and the ink pad in juxtaposition for re-inking between uses.

In use, a golfer reaches within the golf ball compartment of his/her golf bag and retrieves the marking device 10, easily distinguished by feel from the other golf balls in the pocket by means of the protuberance 11 thereon. The golfer may manually pull the two halves apart thereby exposing the ink pad and the fully-inked stamp pad. The upper most surface of the stamp pad is concave to matingly engage the outer curvature of a golf ball. When the golf ball is positioned to rest within the concave recess in the stamp pad portion, the golf ball and the stamp portion are pressed together thereby transferring ink from the stamp pad to the surface of the golf ball. After use, the halves of the case are snapped together again and the marking accessory replaced within the golf ball compartment of the bag where re-inking may occur.

While particular embodiments of the present invention have been illustrated and described, it would be obvious to those skilled in the art that various modifications and changes can be made without departing from the spirit and scope of the invention. It is therefore intended to cover in the appended claims all such changes and modifications that are within the scope of this invention.

What I claim is:

1. A golf ball marker accessory comprising a generally spherical casing divisible into first and second separable hemispherical halves, said first and second hemispherical halves adapted to matingly engage one another to form a spherical body, wherein said first hemispherical half has a projection protruding radially therefrom and a stamp affixed thereto adapted to transfer an inked image to the surface of a golf ball pressed thereagainst; and said second hemispherical half houses in inking pad providing a reservoir for ink, said inking pad being disposed to be in fluid communication with said stamp when said first and second hemispherical halves are in mating engagement with one another.

2. The golf ball marker accessory of claim 1 wherein said stamp has a concave surface dimensioned to matingly engage a portion of the curved convex outer surface of a golf ball, and wherein said ink pad has a convex surface dimensioned to matingly engage the concave surface of said stamp when said first and second halves are in mating engagement with one another.

* * * * *